US008378896B2

(12) United States Patent
Yang et al.

(10) Patent No.: US 8,378,896 B2
(45) Date of Patent: Feb. 19, 2013

(54) WIDE BAND ANTENNA

(75) Inventors: Chih-Yuan Yang, Taipei Hsien (TW); Shih-Yen Peng, Taipei Hsien (TW); Chien-Tang Lin, Taipei Hsien (TW); Hung-Chang Ko, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 335 days.

(21) Appl. No.: 12/841,185

(22) Filed: Jul. 22, 2010

(65) Prior Publication Data

US 2011/0156961 A1 Jun. 30, 2011

(30) Foreign Application Priority Data

Dec. 25, 2009 (CN) ..... 2009 1 0312285

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846
See application file for complete search history.

(56) References Cited

U.S. PATENT DOCUMENTS 7,019,709 B2 * 3/2006 Fukushima et al. ..... 343/846
8,106,834 B2 * 1/2012 Copeland ..... 343/700 MS

* cited by examiner

*Primary Examiner* — Hoang V Nguyen
(74) *Attorney, Agent, or Firm* — Altis Law Group, Inc.

(57) ABSTRACT

A wide band antenna includes a radiation element, a ground surface, a dielectric element, a connector; a first microstrip feeder and a second microstrip feeder. The radiation element is a rectangle shaped and includes a first side and a second side. The lengths of the first side and the second side are not equal. The dielectric element is positioned between the radiation element and the ground surface. One end of the first microstrip feeder is connected to the first side of the radiation element. One end of the second microstrip feeder is connected to the second side of the radiation element, the other ends of the first and second microstrip feeder are connected to the connector.

4 Claims, 4 Drawing Sheets

WIDE BAND ANTENNA

BACKGROUND

1. Technical Field

The present disclosure relates to a wide band antenna and, particularly, to a wide band antenna for mobile communication.

2. Description of Related Art

Referring to FIG. 1, an antenna 1 of related art for mobile communication is shown. The antenna 1 is used for receiving radio frequency (RF) signals and radiating corresponding radio waves. The antenna 1 includes a radiation element 11, a dielectric element 12, a ground surface 13, a microstrip feeder 14, and a connector 15. The radiation element 11, the ground surface 13, and the microstrip feeder 14 are all conductive. The dielectric element 12 is positioned between the radiation element 11 and the ground surface 13. The radiation element 11, the dielectric element 12, and the microstrip feeder 14 are supported by the ground surface 13. The radiation element 11 is a rectangle shaped including a first side 16 and a second side 17. The first side 16 is adjacent to the second side 17. The microstrip feeder 14 is connected to the midpoint of the first side 16 and perpendicular to the first side 16. If a length of the second side 17 of the radiation element 11 is L1, a frequency of the antenna 1 can be computed by the following formula:

$$f = 0.49\frac{V}{L\sqrt{\varepsilon_r}}$$

where, $\in_r$ represents a dielectric coefficient of the dielectric element 12. V represents a velocity of electromagnetic wave. Because $\in_r$ and V are both constant, the frequency f of the antenna 1 is determined by the length of the adjacent side of the first side 16 to which the microstrip feeder 14 is connected. Due to the two adjacent sides of the first side 16 both are L1, only one frequency is generated by the antenna 1.

BRIEF DESCRIPTION OF THE DRAWINGS

The components of the drawings are not necessarily drawn to scale, the emphasis instead being placed upon clearly illustrating the principles of the wide band antenna. Moreover, in the drawings, like reference numerals designate corresponding parts throughout several views.

DETAILED DESCRIPTION

Figure 1:
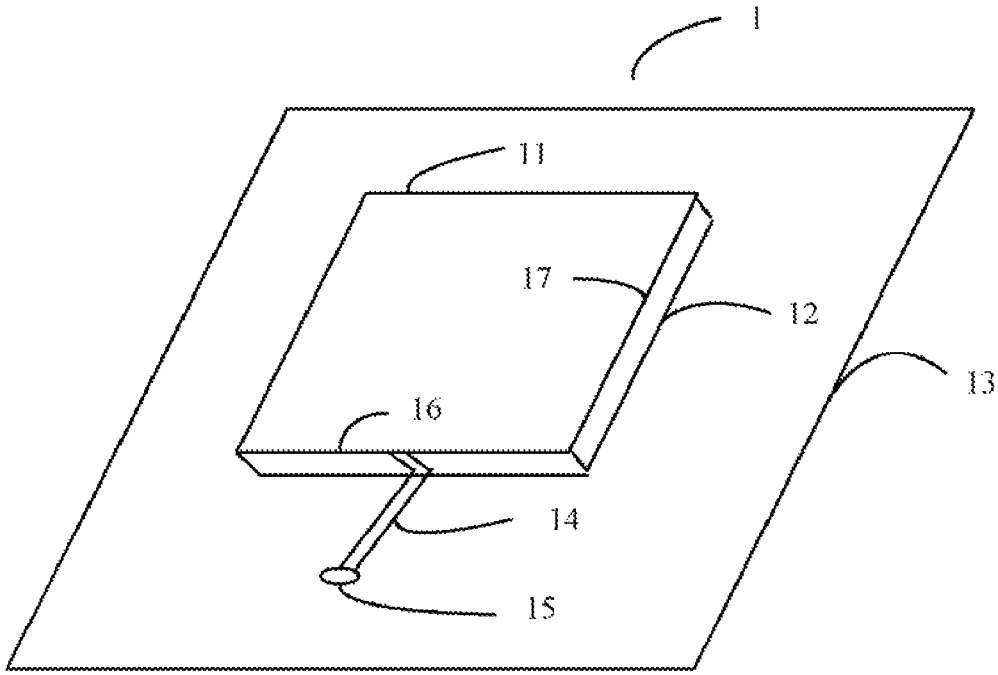
FIG. 1 (Related Art)
FIG. 1 is a schematic view of a related art antenna for mobile communication.
Figure 2:
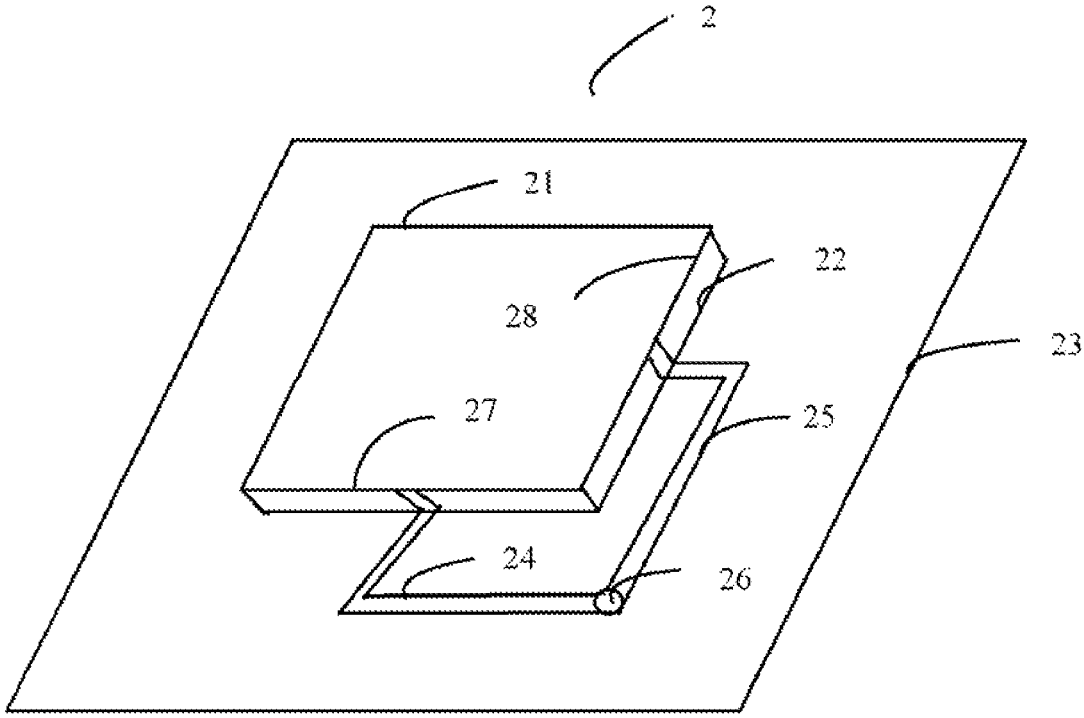
FIG. 2 is a schematic view of a wide band antenna for mobile communication in accordance with one embodiment.

FIG. 2 is a schematic view of a wide band antenna 2 in accordance with an exemplary embodiment. The wide band antenna 2 includes a radiation element 21, a dielectric element 22, a ground element 23, a first microstrip feeder 24, a second microstrip feeder 25, and a connector 26. The functions and structures of the radiation element 21, the dielectric element 22, the ground element 23, and the connector 26 are substantially the same as the radiation element 11, the dielectric element 12, the ground surface 13, and the connector 15 of antenna 1 in FIG. 1. Comparing with the antenna 1, the antenna 2 further includes the second microstrip feeder 25. The first microstrip feeder 24 and the second microstrip feeder 25 are L shaped. The radiation element 21 includes a first side 27 and a second side 28. The length of the first side 27 is not equal to that of the second side 28. One end of the first microstrip feeder 24 is connected to the midpoint of the first side 27 and substantially perpendicular to the first side 27. One end of the second microstrip feeder 25 is connected to the midpoint of the second side 28, and substantially perpendicular to the second side 28. The other ends of the first microstrip feeder 24 and the second microstrip feeder 25 are connected to the connector 26.

Figure 3:
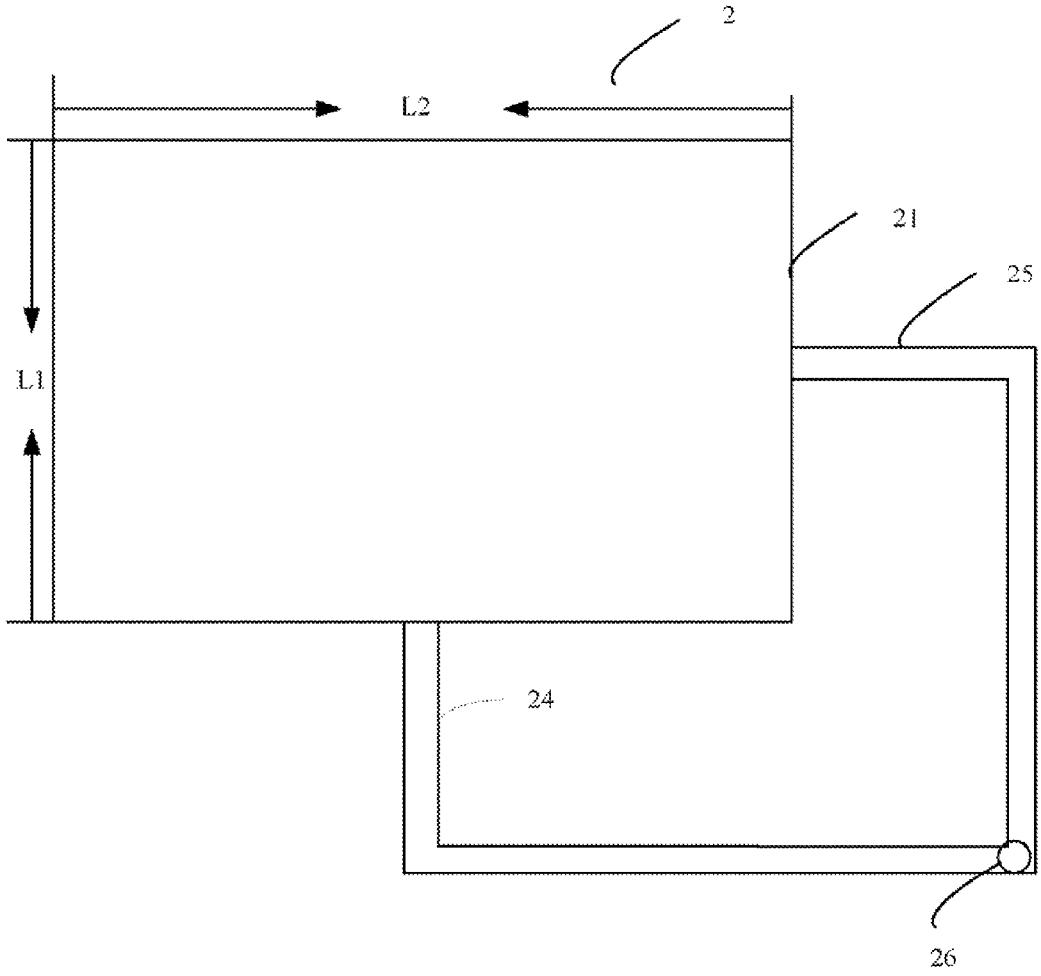
FIG. 3 is a schematic top view of the wide band antenna of FIG. 2.

Referring to FIG. 3, the length of the first side 27 of the radiation element 21 is L1. The length of the second side 28 of the radiation element is L2. L1 is not equal to L2. According to the formula:

$$f = 0.49\frac{V}{L\sqrt{\varepsilon_r}},$$

two frequencies of the antenna 2 are got. The frequency acquired by the first microstrip feeder 24 is:

$$f_1 = 0.49\frac{V}{L_1\sqrt{\varepsilon_r}}.$$

The frequency acquired by the second microstrip feeder 25 is:

$$f_2 = 0.49\frac{V}{L_2\sqrt{\varepsilon_r}},$$

therefore, a wide band antenna is realized.

Figure 4:
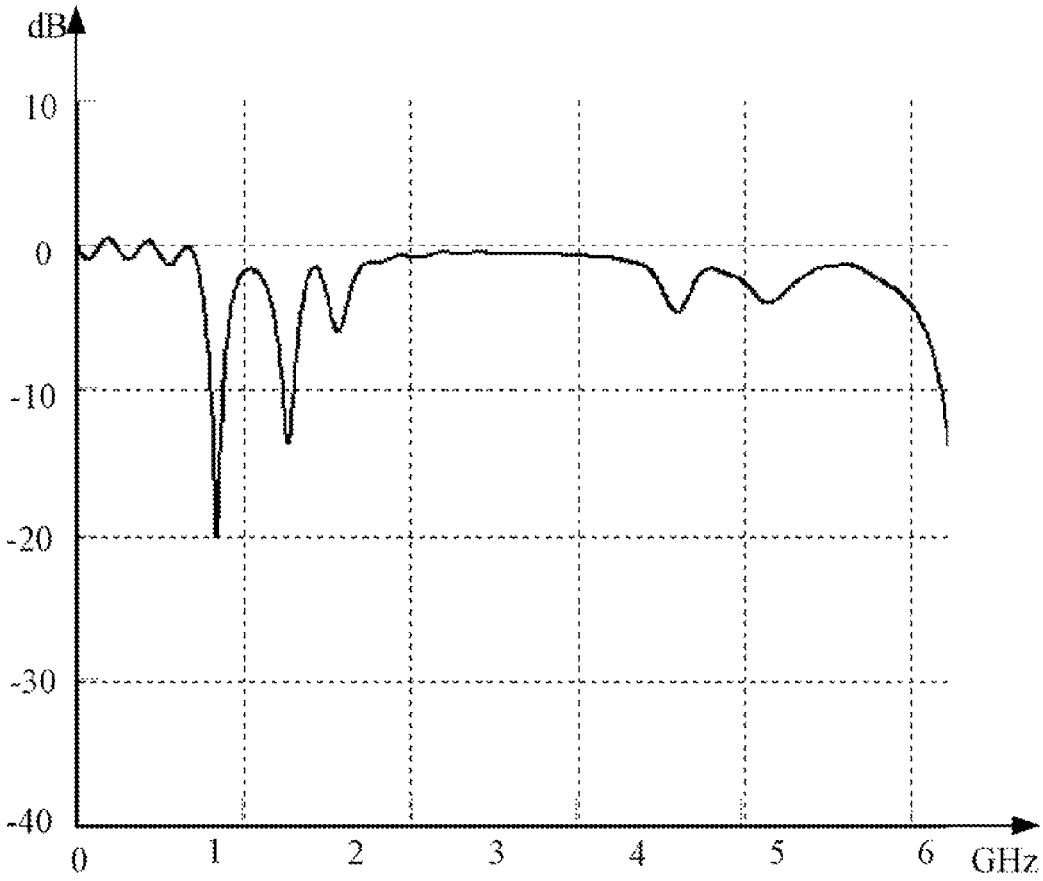
FIG. 4 is an electrical characteristics diagram of the antenna of FIG. 2

FIG. 4 is an electrical characteristics diagram of the antenna 2 to show return losses of the antenna 2 at different frequencies. It can be seen from the diagram when the frequency of the antenna is 0.8 GHz, the return loss of the antenna is −20 db, and when the frequency of the antenna is 1.3 GHz, the return loss of the antenna is −14 db. The return loss corresponding to 0.8 GHz and 1.3 GHz is far below the return losses at the other frequencies. Thus, it is established that the antenna 2 can be an effective wide band antenna.

Although the present disclosure has been specifically described on the basis of preferred embodiments, the disclosure is not to be construed as being limited thereto. Various changes or modifications may be made to the embodiment without departing from the scope and spirit of the disclosure.

What is claimed is:

1. A wide band antenna, comprising:

a radiation element being a rectangular shape comprising a first side and a second side, the lengths of the first side and the second side being not equal;

a ground element;

a dielectric element positioned between the radiation element and the ground element;

a connector;

a first microstrip feeder and a second microstrip feeder, one end of the first microstrip feeder being connected to the first side of the radiation element, one end of the second microstrip feeder being connected to the second side of the radiation element, the other ends of the first and second microstrip feeder being connected to the connector, wherein a first frequency acquired by the first microstrip feeder is:

$$f_2 = 0.49\frac{V}{L_2\sqrt{\varepsilon_r}},$$

a second frequency acquired by the second microstrip feeder is:

$$f_2 = 0.49\frac{V}{L_2\sqrt{\varepsilon_r}},$$

where L1 is a length of the first side of the radiation element, L2 is a length of the second side of the radiation element, and L1 is not equal to L2; $\in_r$ represents a dielectric coefficient of the dielectric element, V represents a velocity of electromagnetic wave.

2. The wide band antenna as described in claim 1, wherein the first microstrip feeder and the second microstrip feeder are L shaped.

3. The wide band antenna as described in claim 2, wherein the one end of the first microstrip feeder is connected to a midpoint of the first side, and the one end of the second microstrip feeder is connected to a midpoint of the second side.

4. The wide band antenna as described in claim 3, wherein the one end of the first microstrip feeder is perpendicular to the first side of the radiation element, and the one end of the second microstrip feeder is perpendicular to the second side of the radiation element.

* * * * *